US012264857B2

(12) United States Patent
Chen et al.

(10) Patent No.: US 12,264,857 B2
(45) Date of Patent: Apr. 1, 2025

(54) LIQUID RESERVOIR FOR REFRIGERATION SYSTEM, AND REFRIGERATOR

(71) Applicants: QINGDAO HAIER SPECIAL REFRIGERATOR CO., LTD, Shandong (CN); QINGDAO HAIER REFRIGERATOR CO., LTD., Shandong (CN); HAIER SMART HOME CO., LTD., Shandong (CN)

(72) Inventors: Jianquan Chen, Qingdao (CN); Jianru Liu, Qingdao (CN); Dongqiang Cao, Qingdao (CN)

(73) Assignees: QINGDAO HAIER SPECIAL REFRIGERATOR CO., LTD, Shandong (CN); QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 202 days.

(21) Appl. No.: 18/042,067

(22) PCT Filed: Jun. 15, 2021

(86) PCT No.: PCT/CN2021/100126
§ 371 (c)(1),
(2) Date: Feb. 17, 2023

(87) PCT Pub. No.: WO2021/223775
PCT Pub. Date: Nov. 11, 2021

(65) Prior Publication Data

US 2023/0304720 A1 Sep. 28, 2023

(30) Foreign Application Priority Data

Aug. 18, 2020 (CN) ..... 202021727434.9

(51) Int. Cl.
*F25B 43/00* (2006.01)
*F25D 17/06* (2006.01)

(52) U.S. Cl.
CPC ..... *F25B 43/006* (2013.01); *F25D 17/067* (2013.01); *F25B 2400/03* (2013.01);
(Continued)

(58) Field of Classification Search
CPC ..... F25B 43/006; F25B 43/00; F25B 2400/03
See application file for complete search history.

(56) References Cited

U.S. PATENT DOCUMENTS 2,450,109 A * 9/1948 Brinkoeter ..... F25D 17/067 62/331
2,994,207 A * 8/1961 Preotle ..... F25D 21/008 62/155

(Continued)

FOREIGN PATENT DOCUMENTS

CN 102494465 A 6/2012
CN 204006834 U 12/2014

(Continued)

OTHER PUBLICATIONS

International Search Report and Written Opinion for PCT/CN2021/100126 (ISA/CN) mailed Sep. 3, 2021 w/partial English translation (11 pages).

(Continued)

*Primary Examiner* — Christopher R Zerphey
(74) *Attorney, Agent, or Firm* — ALSTON & BIRD LLP

(57) ABSTRACT

Provided are a liquid reservoir for a refrigeration system, and a refrigerator. The liquid reservoir comprises: a drum body, a gas-liquid separation chamber being defined therein; and an air intake pipe, used for connecting to an evaporating pipe of an evaporator of the refrigeration system, and extending into the gas-liquid separation chamber from one (Continued)

end of the drum body, the end of the air intake pipe extending into the gas-liquid separation chamber being provided with a baffle opposite to a mouth of the air intake pipe, such that a mixture discharged from the air intake pipe hits the baffle and is discharged into the gas-liquid separation chamber from an interval between the baffle and the air intake pipe.

9 Claims, 5 Drawing Sheets

(52) U.S. Cl.
CPC ..... *F25D 2317/0661* (2013.01); *F25D 2317/067* (2013.01); *F25D 2317/0683* (2013.01); *F25D 2500/02* (2013.01)

(56) References Cited

U.S. PATENT DOCUMENTS

| | | | | | |
|---|---|---|---|---|---|
| 3,027,735 | A * | 4/1962 | Preotle | F25D 17/062 | 62/407 |
| 3,104,533 | A * | 9/1963 | O'Connell | F25D 17/065 | 62/526 |
| 3,111,135 | A * | 11/1963 | Butsch | F25B 43/006 | 62/509 |
| 3,252,292 | A * | 5/1966 | O'Connell | F25D 17/065 | 62/298 |
| 3,365,118 | A * | 1/1968 | Winfield, Jr. | F25D 17/065 | 415/223 |
| 3,433,031 | A * | 3/1969 | Koch | F25D 19/02 | 62/448 |
| 3,512,374 | A * | 5/1970 | Grahl | F25B 43/006 | 62/503 |
| 3,599,442 | A * | 8/1971 | Hanson | F25D 17/065 | 62/285 |
| 3,837,177 | A * | 9/1974 | Rockwell | F25B 43/006 | 62/503 |
| 4,061,482 | A * | 12/1977 | Smith | F25D 17/065 | 62/155 |
| 4,223,538 | A * | 9/1980 | Braden | F25D 17/065 | 312/236 |
| 5,706,850 | A * | 1/1998 | Nares | F04B 39/04 | 62/503 |
| 5,727,398 | A * | 3/1998 | Phillippe | F25B 41/30 | 138/40 |
| 6,401,471 | B1 * | 6/2002 | Wightman | F16K 5/12 | 236/93 R |
| 7,488,361 | B2 * | 2/2009 | Larnholm | B01D 45/16 | 55/318 |
| 8,372,172 | B2 * | 2/2013 | Murakami | F25B 43/00 | 60/512 |
| 9,702,602 | B2 * | 7/2017 | Phillippe | F25B 43/006 | |
| 10,317,115 | B2 * | 6/2019 | Han | F25D 23/069 | |
| 10,876,774 | B2 * | 12/2020 | Wada | F25B 43/006 | |
| 11,022,352 | B2 * | 6/2021 | Khoo | F25B 1/00 | |
| 12,111,095 | B2 * | 10/2024 | Li | F25D 23/028 | |
| 2003/0079496 | A1 * | 5/2003 | Schroeder | B01D 45/06 | 62/503 |
| 2013/0111934 | A1 | 5/2013 | Wang et al. | | |
| 2024/0318893 | A1 * | 9/2024 | Chung | F25D 17/062 | |

FOREIGN PATENT DOCUMENTS

| | | | | |
|---|---|---|---|---|
| CN | 105605837 | A | 5/2016 | |
| CN | 106052202 | A | 10/2016 | |
| CN | 205843155 | U | 12/2016 | |
| CN | 206247720 | U | 6/2017 | |
| CN | 108759196 | A | 11/2018 | |
| CN | 208832796 | U | 5/2019 | |
| CN | 210036003 | U | 2/2020 | |
| JP | S48-055501 | A | 8/1973 | |
| JP | S51-092565 | A | 8/1976 | |
| JP | S63-065271 | A | 3/1988 | |
| JP | S63-502692 | | 10/1988 | |
| JP | H09-079707 | A | 3/1997 | |
| JP | H0979707 | * | 3/1997 | F25B 43/00 |
| JP | H09250848 | A | 9/1997 | |
| JP | 2004-239527 | A | 8/2004 | |
| JP | 2007-278688 | A | 10/2007 | |
| JP | 2011-247575 | A | 12/2011 | |
| JP | 2020-070961 | A | 5/2020 | |
| KR | 20080050156 | A | 6/2008 | |
| KR | 20110119553 | A | 11/2011 | |
| WO | WO 2012/012491 | A2 | 1/2012 | |
| WO | WO 2020/137230 | A1 | 7/2020 | |

OTHER PUBLICATIONS

European Search Report for European Patent Application No. 21800418.2 dated Nov. 8, 2003 (4 pages).
Office Action for European Patent Application No. 21800418.2 dated Nov. 20, 2023 (4 pages).
Office Action for Japanese Patent Application No. 2023-511901 dated Feb. 26, 2024 (14 pages).
1st Examination Report for Australia Patent Application No. 20212665850 dated Oct. 27, 2023 (3 pages).
Decision of Refusal for JP Patent Application No. 2023-511901 dated Sep. 2, 2024, w/English translation (8 pages).

* cited by examiner

LIQUID RESERVOIR FOR REFRIGERATION SYSTEM, AND REFRIGERATOR

CROSS-REFERENCE TO RELATED APPLICATIONS

The present application is a national phase entry of International Application No. PCT/CN2021/100126, filed Jun. 15, 2021, which claims priority to Chinese Application No. 202021727434.9, filed Aug. 18, 2020, which are each incorporated herein by reference in its entirety.

FIELD OF THE INVENTION

The present invention relates to the technical field of household appliances, and in particular to a liquid reservoir for a refrigeration system, and a refrigerator.

BACKGROUND OF THE INVENTION

A refrigeration system of a refrigerator is formed by connecting main components such as a compressor, a condenser, a filter, a capillary pipe, an evaporator and an air return pipe, and some pipelines. A liquid reservoir of the refrigerator is designed between the evaporator and the air return pipe. On the one hand, gas-liquid separation of a refrigerant is realized, and a liquid refrigerant is stored in the liquid reservoir first to ensure that a gas returns to the compressor, so as to prevent a liquid impact on the compressor. On the other hand, a certain amount of the liquid refrigerant is stored, and the dosage of the refrigerant for a cycle of the refrigeration system is adjusted according to an ambient temperature.

An existing liquid reservoir is designed with an oil return hole at the bottom of an air intake pipe of the liquid reservoir. When a mixture of a refrigerant and compressor oil enters the liquid reservoir, the oil sinks to the bottom of the liquid reservoir due to a large specific gravity, and the gaseous refrigerant returns to the compressor through an air outlet pipe and enters a refrigeration cycle again. The compressor oil enters an upper part of the liquid reservoir under the impact of an airflow in the air intake pipe, and is sucked into the compressor for lubrication. However, due to the large specific gravity of the compressor oil, the compressor oil cannot fully return to the compressor. Secondly, the oil return hole of the compressor is formed below the liquid level of the refrigerant, which causes refrigerant bubbles to emit in the oil return hole, thereby causing the phenomenon of air blowing liquid and generating noise. Further, the gasification efficiency of the liquid refrigerant in the above liquid reservoir is also relatively low.

BRIEF DESCRIPTION OF THE INVENTION

An objective of the present invention is to provide a liquid reservoir for a refrigeration system, and a refrigerator to overcome the above problems or at least partially solve the above problems.

A further objective of the present invention is to improve the gasification efficiency of a liquid refrigerant in the liquid reservoir, so as to improve the refrigeration efficiency of the refrigerator.

Another further objective of the present invention is to improve the recovery efficiency of compressor oil.

Another further objective of the present invention is to reduce noise generated by the liquid reservoir.

Particularly, the present invention provides a liquid reservoir for a refrigeration system, comprising: a drum body, a gas-liquid separation chamber being defined therein; and an air intake pipe, used for connecting to an evaporating pipe of an evaporator of the refrigeration system, and extending into the gas-liquid separation chamber from one end of the drum body, the end of the air intake pipe extending into the gas-liquid separation chamber being provided with a baffle opposite to a mouth of the air intake pipe, so that a mixture discharged from the air intake pipe hits the baffle and then is discharged into the gas-liquid separation chamber from an interval between the baffle and the air intake pipe.

Further, the liquid reservoir further comprises: a plurality of support ribs, extending out from the end of the air intake pipe extending into the gas-liquid separation chamber along the extension direction of the air intake pipe, the baffle being fixedly connected to the support ribs to form the interval between the baffle and the air intake pipe by means of the plurality of support ribs.

Further, the pipe diameter of the part of the air intake pipe extending into the gas-liquid separation chamber gradually shrinks with the increase of an extending length.

Further, the liquid reservoir further comprises: an exhaust pipe, extending into the gas-liquid separation chamber from the other end of the drum body, a set interval being formed between the end of the exhaust pipe extending into the gas-liquid separation chamber and the baffle.

Further, the length of the exhaust pipe extending into the gas-liquid separation chamber is less than the length of the air intake pipe extending into the gas-liquid separation chamber.

The present invention further provides a refrigerator, which comprises an evaporator and the liquid reservoir described in any one of the above embodiments, the liquid reservoir being connected to an evaporating pipe of the evaporator.

Further, the refrigerator further comprises: a refrigerator body, provided with a bottom liner, the bottom liner defining a cooling chamber and a storage space, and the cooling chamber being arranged below the storage space; the evaporator is entirely in a flat cuboid shape and is arranged at a front part of the cooling chamber; and the liquid reservoir is arranged behind the evaporator.

Further, the liquid reservoir is arranged obliquely and upwards from the end with the air intake pipe.

Further, the evaporator is a finned evaporator, comprising: a group of fins, arranged in parallel along the front-and-back direction of the refrigerator body; an evaporating pipe, penetrating through the fins; and support end plates, arranged on both sides of the fins, wherein an outlet of the evaporating pipe is arranged behind the support end plate on one side, and extends to the liquid reservoir in an arc shape.

Further, the evaporator is obliquely arranged along the depth direction of the refrigerator relative to the horizontal direction, the oblique direction is upward from front to back, and the refrigerator further comprises: an air duct cover plate, arranged in the front of a back wall of the bottom liner, and defining an air supply duct with the back wall of the bottom liner, the air duct cover plate being provided with at least one air supply outlet, and the air supply outlet being used for connecting the air supply duct and the storage space; and a centrifugal fan, obliquely arranged on a back side of the evaporator entirely, and used for causing formation of a refrigerating airflow from air in front of the cooling chamber discharged to the air supply duct through the evaporator, the distances from the center of an air inlet of the centrifugal fan to side plates on both sides of the bottom liner being different, and the distance from the center of the air inlet to a side wall of the bottom liner close to the outlet of the evaporating pipe being greater than the distance to a side wall of the bottom liner away from the outlet of the evaporating pipe.

In the liquid reservoir for the refrigeration system, and the refrigerator in the present invention, since the baffle is arranged in the liquid reservoir in a position opposite to the air intake pipe, the refrigerant discharged from the air intake pipe is atomized after hitting the baffle, and the atomized liquid refrigerant can be gasified more quickly, so as to improve the gasification efficiency of the liquid refrigerant in the liquid reservoir, thereby improving the refrigeration efficiency of the refrigerator, and preventing the liquid refrigerant from entering a compressor and causing adverse effects on the compressor.

Further, in the liquid reservoir for the refrigeration system, and the refrigerator in the present invention, by arranging the baffle in a position opposite to the air intake pipe, compressor oil discharged from the air intake pipe is atomized after hitting the baffle, and the atomized oil returns to an air outlet pipe and enters the compressor more efficiently, so as to realize effective lubrication of the compressor and improve the recovery efficiency of the oil.

Further, in the liquid reservoir for the refrigeration system, and the refrigerator in the present invention, the design of an oil return hole at the bottom of the air intake pipe is omitted, so as to prevent refrigerant bubbles from emitting through the oil return hole, thereby reducing the noise generated by the liquid reservoir.

The above and other objectives, advantages and features of the present invention will be more apparent to those skilled in the art from the following detailed description of the specific embodiments of the present invention with reference to the drawings.

BRIEF DESCRIPTION OF THE DRAWINGS

Some specific embodiments of the present invention are described in detail below in an exemplary manner rather than a restrictive manner with reference to the drawings. The same reference numerals in the drawings indicate the same or similar components or parts. Those skilled in the art should understand that these drawings are not necessarily drawn to scale. In the drawings.

DETAILED DESCRIPTION

Figure 1:
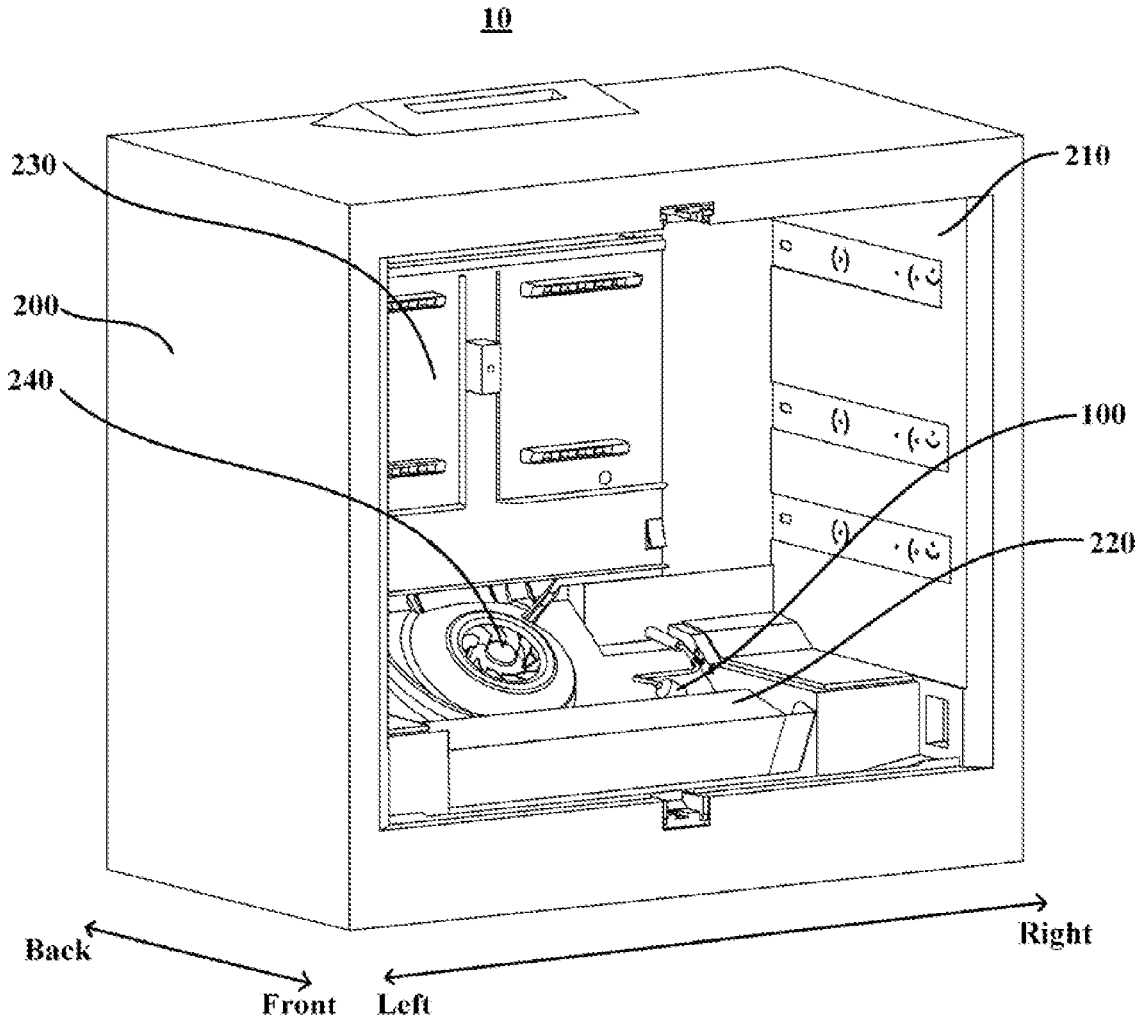
FIG. 1 is a schematic structural view of a refrigerator according to an embodiment of the present invention.
Figure 2:
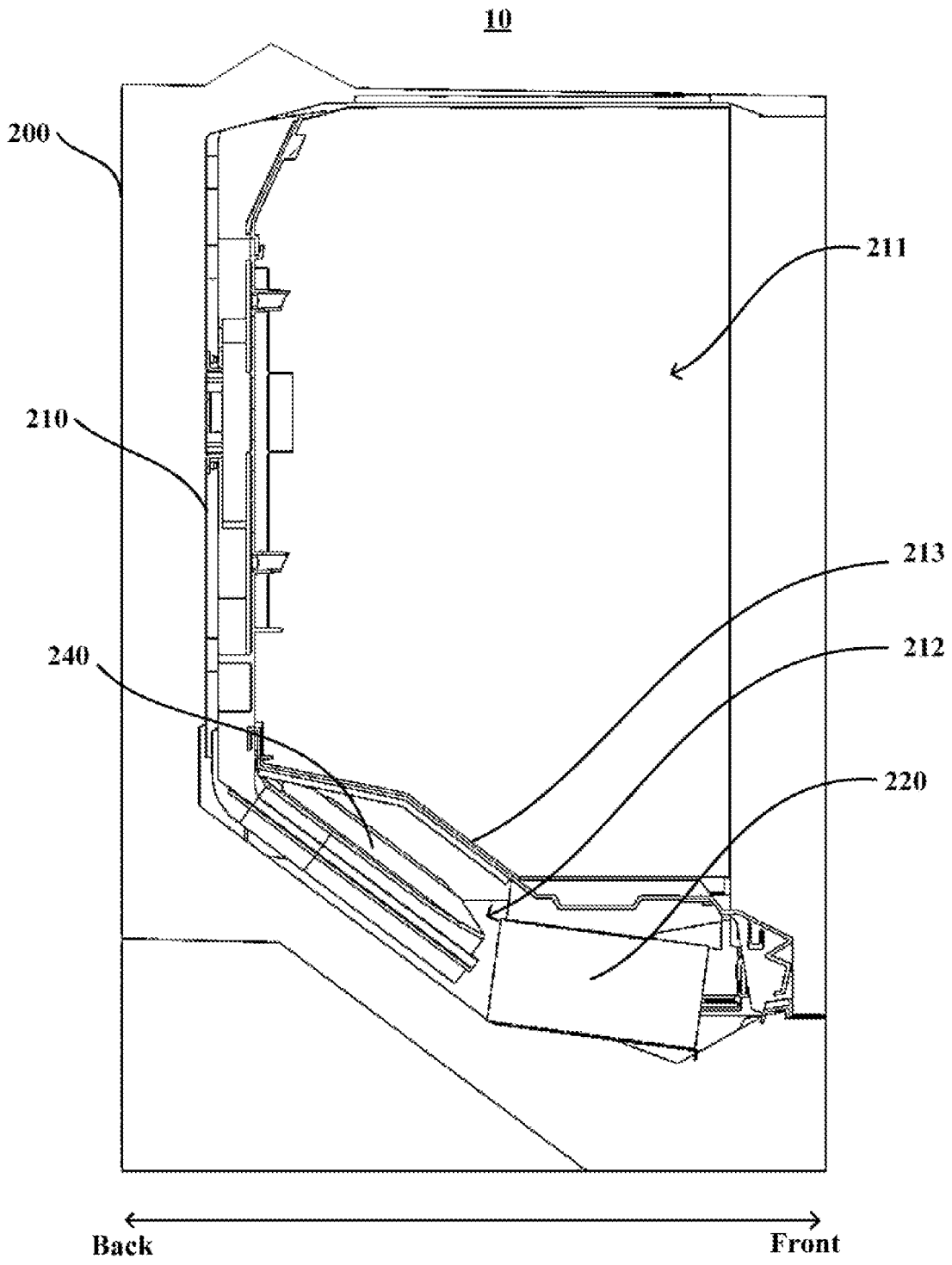
FIG. 2 is a schematic cross-sectional view of a refrigerator according to an embodiment of the present invention.

In the description of this embodiment, it should be understood that the orientations or position relationships indicated by terms "upper", "lower", "front", "back", "left", "horizontal", "bottom", "depth" and the like are based on orientations of a refrigerator under normal service conditions, and can be determined with reference to the orientations or position relationships shown in the drawings. For example, the "front" indicating the orientation refers to one side of the refrigerator facing a user. These terms are only for the convenience of describing the present invention and simplifying the description, but do not indicate or imply that the specified device or component must have a specific orientation and must be constructed and operated in the specific orientation, so it can not be understood as a limitation to the present invention.

This embodiment first provides a liquid reservoir 100 for a refrigeration system. The liquid reservoir 100 may include a drum body 110 and an air intake pipe 130. A gas-liquid separation chamber 120 is defined in the drum body 110. The air intake pipe 130 is used for connecting to an evaporating pipe 222 of an evaporator 220 of the refrigeration system, and extends into the gas-liquid separation chamber 120 from one end of the drum body 110, and the end of the air intake pipe 130 extending into the gas-liquid separation chamber 120 is provided with a baffle 140 opposite to a mouth of the air intake pipe 130, so that a mixture discharged from the air intake pipe 130 hits the baffle 140 and then is discharged into the gas-liquid separation chamber 120 from an interval between the baffle 140 and the air intake pipe 130.

Generally, the refrigeration system may further include a compressor 250, a condenser 260, a filter 270 and a throttling element 280, wherein the throttling element 280 may be a capillary pipe. Since the working principle of the refrigeration system is known to those skilled in the art, the working principle will not be described here. In the scheme of this embodiment, the liquid reservoir 100 is arranged between the compressor 250 and the evaporator 220 to perform gas-liquid separation of a refrigerant flowing from the evaporator 220 to the compressor 250, so as to prevent the liquid refrigerant from entering the compressor 250 and affecting the normal operation of the compressor 250.

In the scheme of this embodiment, by arranging the baffle 140, the mixture discharged from the air intake pipe 130 hits the baffle 140 so as to facilitate atomization of the mixture. In this embodiment, the mixture discharged from the air intake pipe 130 is a gas-liquid mixture of a refrigerant and compressor oil, the refrigerant liquid in the mixture is atomized after hitting the baffle 140, and the atomized liquid refrigerant can be gasified more quickly, so as to improve the gasification efficiency of the liquid refrigerant in the liquid reservoir 100, thereby improving the refrigeration efficiency of a refrigerator 10, and preventing the liquid refrigerant from entering the compressor 250 and causing adverse effects on the compressor 250.

Further, in this embodiment, the compressor oil in the mixture is atomized after hitting the baffle 140, and the atomized compressor oil is more easily driven by an airflow to enter the compressor 250, so as to realize effective lubrication of the compressor 250 and improve the recovery efficiency of the oil.

The liquid reservoir 100 may further include a plurality of support ribs 150. The plurality of support ribs 150 extend out from the end of the air intake pipe 130 extending into the gas-liquid separation chamber 120 along the extension direction of the air intake pipe 130. Furthermore, the baffle 140 is fixedly connected to the support ribs 150 to form the interval between the baffle 140 and the air intake pipe 130 by means of the plurality of support ribs 150.

In the scheme of this embodiment, by a combined action of the plurality of support ribs 150, the baffle 140 is fixed in a position opposite to the mouth of the air intake pipe 130, so that the structural position of the baffle 140 is more stable. Under the impact of the airflow discharged from the air intake pipe 130, the baffle 140 can still be kept in a fixed position, thereby ensuring the effective atomization of the mixture discharged from the air intake pipe 130.

The pipe diameter of the part of the air intake pipe 130 extending into the gas-liquid separation chamber 120 may gradually shrink with the increase of an extending length. In the scheme of this embodiment, by setting the pipe diameter of the part of the air intake pipe 130 extending into the gas-liquid separation chamber 120 to gradually shrink with the increase of the extending length, that is, setting the air intake pipe 130 as a tapered pipe, when the mixture airflow discharged from the air intake pipe 130 hits the baffle, the impact force is greater, thereby improving the atomization effect of the mixture.

The liquid reservoir 100 may further include an exhaust pipe 160. The exhaust pipe 160 extends into the gas-liquid separation chamber 120 from the other end of the drum body 110, and a set interval is formed between the end of the exhaust pipe 160 extending into the gas-liquid separation chamber 120 and the baffle 140.

In this embodiment, the exhaust pipe 160 conveys the refrigerant airflow entering the gas-liquid separation chamber 120 into the compressor 250, and the set interval is formed between the end of the exhaust pipe 160 extending into the gas-liquid separation chamber 120 and the baffle 140, so that a gaseous refrigerant can enter the exhaust pipe 160 conveniently. Further, since there is an interval between the exhaust pipe 160 and the baffle 140, that is, there is a certain distance between the exhaust pipe 160 and the air intake pipe 130, when a large amount of liquid refrigerant is stored in the liquid reservoir 100, the excessive liquid refrigerant will return to the evaporator 220 from the mouth of the air intake pipe 130, so as to ensure that the liquid refrigerant deposited in the liquid reservoir 100 will not enter the exhaust pipe 160 to prevent the liquid refrigerant from entering the compressor 250 and then causing adverse effects on the operation of the compressor 250.

The length of the exhaust pipe 160 extending into the gas-liquid separation chamber 120 may be less than the length of the air intake pipe 130 extending into the gas-liquid separation chamber 120. In the scheme of this embodiment, the highest position of the liquid level of the liquid refrigerant in the liquid reservoir 100 is the position of the mouth of the air intake pipe 130. When there is excessive liquid refrigerant, the liquid refrigerant will return from the mouth of the air intake pipe 130. In other words, the longer the exhaust pipe 160 extending into the gas-liquid separation chamber 120 is, the more the liquid refrigerant can be stored in the liquid reservoir 100. By setting the length of the exhaust pipe 160 extending into the gas-liquid separation chamber 120 to be less than the length of the air intake pipe 130 extending into the gas-liquid separation chamber 120, a larger storage space for the liquid refrigerant can be ensured in the liquid reservoir 100. When the atomized refrigerant in the liquid reservoir 100 is saturated, the refrigerant will naturally condense into liquid and accumulate at the bottom of the liquid reservoir 100, so as to store the excessive refrigerant. By storing a certain amount of liquid refrigerant in the liquid reservoir 100, the dosage of the refrigerant for a cycle of the refrigeration system can be adjusted according to an ambient temperature. When the ambient temperature decreases, the refrigerant participating in a cycle of the system decreases, and the liquid reservoir 100 can store the excessive refrigerant. When the ambient temperature rises, the system needs more refrigerant for a cycle, and the refrigerant stored in the liquid reservoir 100 participates in the refrigeration cycle, so that the refrigerator 10 can achieve a better refrigeration effect at different ambient temperatures.

This embodiment further provides a refrigerator 10. The refrigerator 10 may include an evaporator 220 and any one of the above liquid reservoirs 100. The liquid reservoir 100 is connected to an evaporating pipe 222 of the evaporator 220.

In the scheme of this embodiment, by connecting the liquid reservoir 100 to the evaporating pipe 222 of the evaporator 220, gas-liquid separation of a refrigerant flowing from the evaporator 220 into the liquid reservoir 100 through the evaporating pipe 222 is realized, and a liquid refrigerant is stored in the liquid reservoir 100 first to ensure that a gas returns to the compressor 250, so as to prevent a liquid impact on the compressor 250.

The refrigerator 10 in this embodiment may further include a refrigerator body 200. The refrigerator body 200 is provided with a bottom liner 210, the bottom liner 210 defines a cooling chamber 212 and a storage space 211, and the cooling chamber 212 is arranged below the storage space 211. The evaporator 220 is entirely in a flat cuboid shape and is arranged at a front part of the cooling chamber 212. The liquid reservoir 100 is arranged behind the evaporator 220. A front side of the refrigerator body 200 is further provided with a door body for opening or closing the storage space 211. In order to show the internal structure of the refrigerator body 200, the door body is hidden in the drawing.

Generally, the refrigerator 10 can be provided with a plurality of liners which can be divided into a freezing liner, a variable-temperature liner and a refrigerating liner according to functions, so as to define a plurality of storage compartments, such as a refrigerating compartment, a variable-temperature compartment and a freezing compartment. In this embodiment, the bottom liner 210 refers to a liner at the bottom of the refrigerator 10.

In this embodiment, the bottom liner 210 at the bottom of the refrigerator 10 defines the storage space 211 and the cooling chamber 212 below the storage space 211 through a partition plate 213, wherein the storage space 211 defined by the bottom liner 210 may be a freezing compartment. Furthermore, a variable-temperature compartment defined by other liners of the refrigerator 10, and a refrigerating compartment above the variable-temperature compartment may further be arranged above the storage space 211.

The liquid reservoir 100 is arranged obliquely and upwards from the end with the air intake pipe 130. In the scheme of this embodiment, an angle of the obliquely arranged liquid reservoir 100 may be 10-35 degrees. By arranging the liquid reservoir 100 obliquely and upwards from the end with the air intake pipe 130, on the one hand, the shape of the bottom liner 210 can be fit better, a small space in the cooling chamber 212 is occupied, and the space utilization efficiency of the cooling chamber 212 is improved; and on the other hand, by obliquely arranging the liquid reservoir 100, the excessive liquid refrigerant stored in the liquid reservoir 100 can return to the evaporator 220 conveniently, so as to further ensure that the liquid refrigerant deposited in the liquid reservoir 100 cannot enter the exhaust pipe 160.

The evaporator 220 is a finned evaporator. The finned evaporator may include: a group of fins, an evaporating pipe 222 and support end plates 221. The group of fins are arranged in parallel along the front-and-back direction of the refrigerator body 200. The evaporating pipe 222 penetrates through the fins. The support end plates 221 are arranged on both sides of the fins. An outlet of the evaporating pipe 222 is arranged behind the support end plate 221 on one side, and extends to the liquid reservoir 100 in an arc shape.

The scheme of this embodiment uses the finned evaporator which is compact in structure, small in occupied area and high in heat transfer coefficient, thereby further improving the heat exchange efficiency of the evaporator 220, and ensuring the refrigeration and storage functions of the refrigerator 10.

The evaporator 220 is obliquely arranged along the depth direction of the refrigerator 10 relative to the horizontal direction, the oblique direction is upward from front to back, and the refrigerator 10 may further include an air duct cover plate 230 and a centrifugal fan 240. The air duct cover plate 230 is arranged in the front of a back wall of the bottom liner 210, and defines an air supply duct with the back wall of the bottom liner 210, the air duct cover plate 230 is provided with at least one air supply outlet 231, and the air supply outlet 231 is used for connecting the air supply duct and the storage space 211. The centrifugal fan 240 is obliquely arranged on a back side of the evaporator 220 entirely, and used for causing formation of a refrigerating airflow from air in front of the cooling chamber 212 discharged to the air supply duct through the evaporator 220, the distances from the center of an air inlet 241 of the centrifugal fan 240 to side plates on both sides of the bottom liner 210 are different, and the distance from the center of the air inlet 241 to a side wall of the bottom liner 210 close to the outlet of the evaporating pipe 222 is greater than the distance to a side wall of the bottom liner 210 away from the outlet of the evaporating pipe 222.

In a refrigerator with an evaporator mounted at the bottom in the prior art, the evaporator is horizontally arranged. When an airflow enters a cooling chamber, the airflow is easy to gather at the front end of the evaporator and cannot enter the evaporator smoothly for heat exchange. In this embodiment, the evaporator 220 is obliquely arranged, so that the arrangement of components in the cooling chamber 212 is more reasonable. Moreover, the analysis of an actual airflow field proves that the air cycle efficiency is higher, and the drainage is more smooth.

Figure 3:
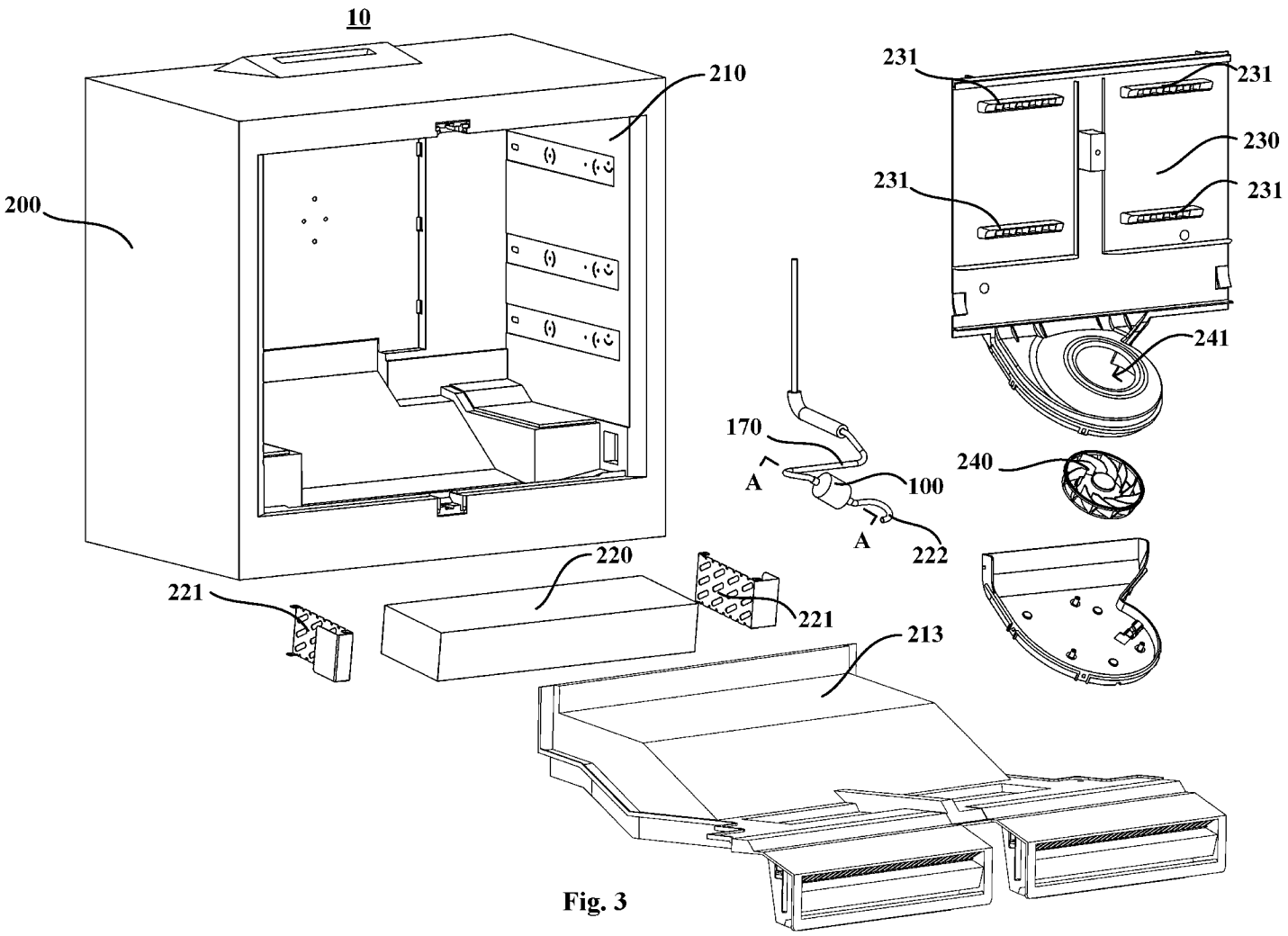
FIG. 3 is a schematic exploded view of a refrigerator according to an embodiment of the present invention.
Figure 4:
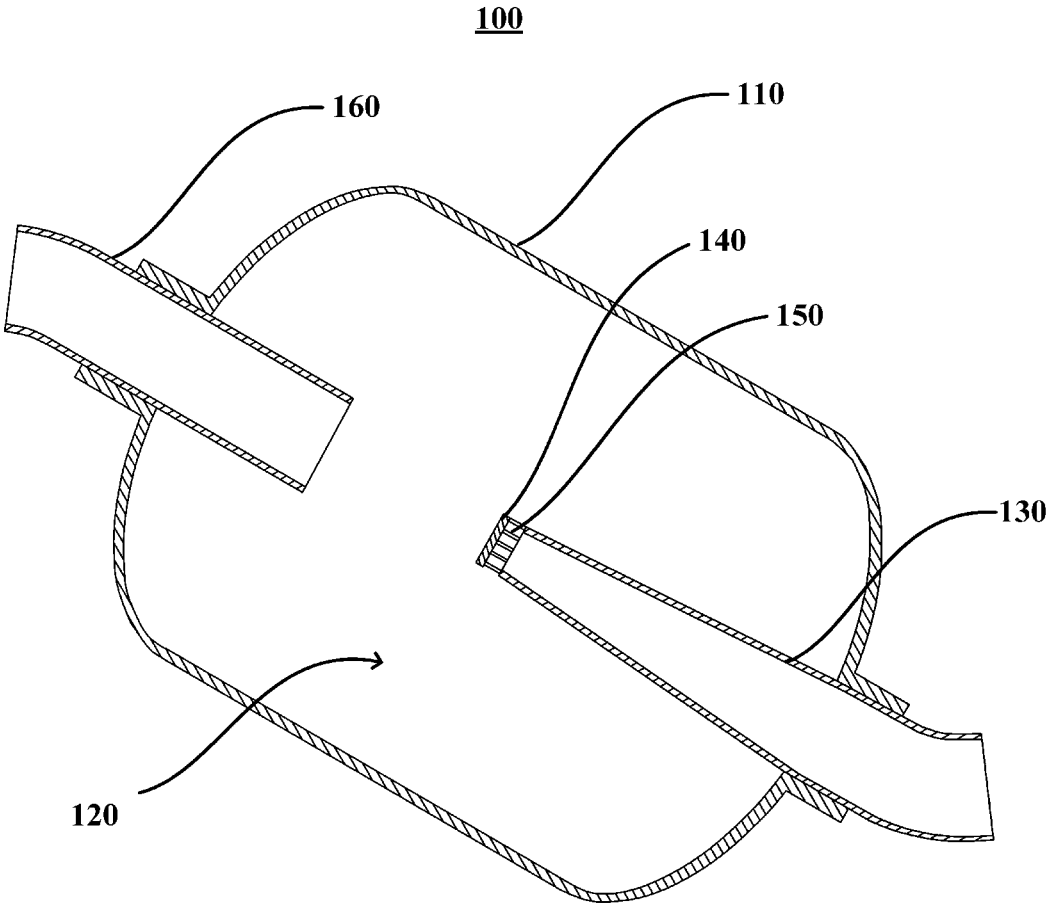
FIG. 4 is a schematic cross-sectional view of a liquid reservoir in FIG. 3 taken along a section line A-A.
Figure 5:
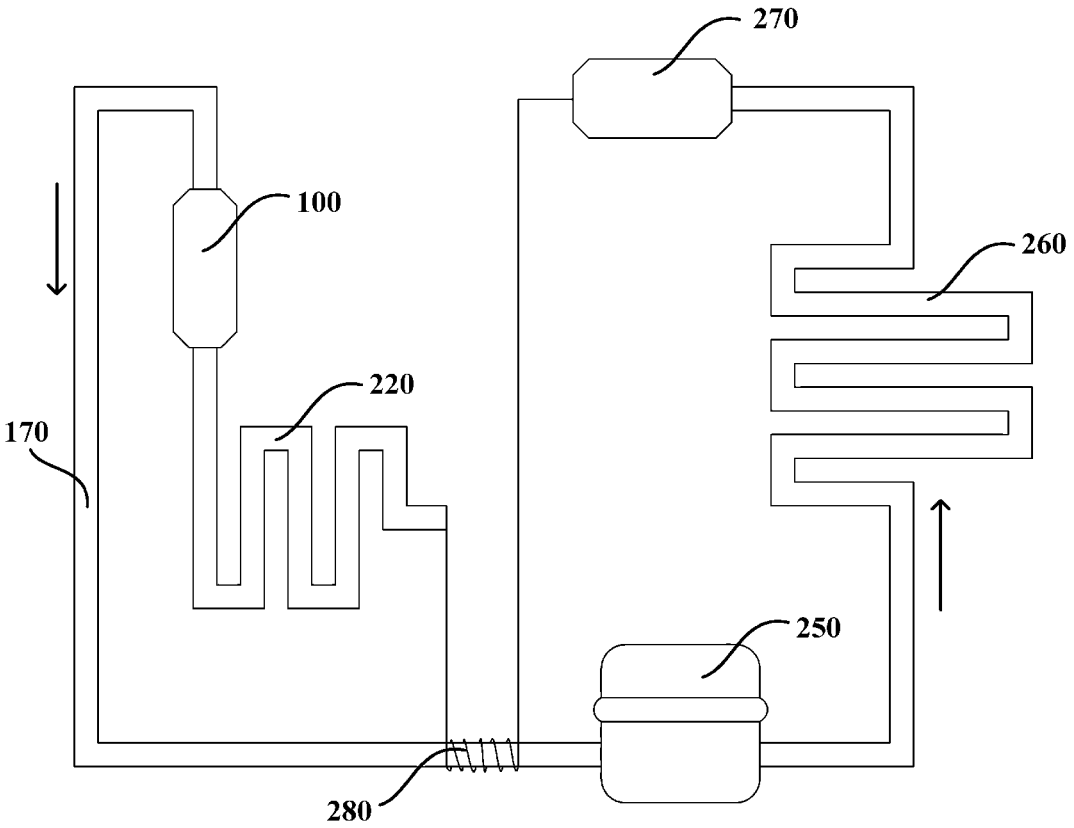
FIG. 5 is a working principle diagram of a refrigeration system of a refrigerator according to an embodiment of the present invention.

In the scheme of this embodiment, by arranging the air duct cover plate 230 and the centrifugal fan 240 at the back of the bottom liner 210, the flow rate of refrigerating air flowing from the cooling chamber 212 into the storage space 211 is increased, so as to further ensure the refrigeration and storage effects of the refrigerator 10. In the scheme of this embodiment, one or a plurality of air supply outlets 231 may be arranged. In an embodiment as shown in FIG. 3, four air supply outlets 231 are arranged on the air duct cover plate 230, so that the air supply is more uniform and smooth.

The scheme of this embodiment uses the centrifugal fan 240 which is stable in operation and convenient in maintenance, and is sturdy and durable. Further, in this embodiment, the distance from the center of the air inlet 241 of the centrifugal fan 240 to a side wall of the bottom liner 210 close to an air return pipe 170 is greater than the distance to a side wall of the bottom liner 210 away from the air return pipe 170. In other words, the center of the air inlet 241 of an air supply fan is inclined to a left wall of the bottom liner 210, that is, the air supply fan is arranged in a position inclined to the left side of the bottom liner 210, so that the refrigerating air flows more smoothly from the air outlet of the fan to the air supply duct, so as to further improve the air supply efficiency of the fan. The mounting position of the centrifugal fan 240 is structurally optimized according to space requirements and refrigeration performance requirements, and the effect is verified by trial products.

In the scheme of this embodiment, by arranging the baffle 140 in the liquid reservoir 100 in a position opposite to the mouth of the air intake pipe 130, the mixture discharged from the air intake pipe 130 hits the baffle 140 so as to facilitate atomization of the mixture. On the one hand, the refrigerant liquid in the mixture is atomized after hitting the baffle 140, and the atomized liquid refrigerant can be gasified more quickly, so as to improve the gasification efficiency of the liquid refrigerant in the liquid reservoir 100, thereby improving the refrigeration efficiency of the refrigerator 10, and preventing the liquid refrigerant from entering the compressor 250 and causing adverse effects on the compressor 250. On the other hand, the compressor oil in the mixture is atomized after hitting the baffle 140, and the atomized compressor oil is more easily driven by an airflow to enter the compressor 250, so as to realize effective lubrication of the compressor 250 and improve the recovery efficiency of the compressor oil.

Further, in the scheme of this embodiment, the design of an oil return hole at the bottom of the air intake pipe 130 is omitted, so as to prevent refrigerant bubbles from emitting through the oil return hole, thereby reducing the noise generated by the liquid reservoir 100.

Thus, those skilled in the art should recognize that although multiple exemplary embodiments of the present invention have been shown and described in detail, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

The invention claimed is:

1. A liquid reservoir for a refrigeration system, comprising:

a drum body, a gas-liquid separation chamber being defined therein; and an air intake pipe, used for connecting to an evaporating pipe of an evaporator of the refrigeration system, and extending into the gas-liquid separation chamber from one end of the drum body, the end of the air intake pipe extending into the gas-liquid separation chamber being provided with a baffle opposite to a mouth of the air intake pipe, so that a mixture discharged from the air intake pipe hits the baffle and then is discharged into the gas-liquid separation chamber from an interval between the baffle and the air intake pipe, wherein the pipe diameter of the part of the air intake pipe extending into the gas-liquid separation chamber gradually shrinks from the section of the air intake pipe in contact with the drum body to the end of the air intake pipe provided with the baffle with the increase of an extending length.

2. The liquid reservoir according to claim 1, further comprising:

a plurality of support ribs, extending out from the end of the air intake pipe extending into the gas-liquid separation chamber along the extension direction of the air intake pipe, the baffle being fixedly connected to the support ribs to form the interval between the baffle and the air intake pipe by means of the plurality of support ribs.

3. The liquid reservoir according to claim 1, further comprising:

an exhaust pipe, extending into the gas-liquid separation chamber from the other end of the drum body, a set interval being formed between the end of the exhaust pipe extending into the gas-liquid separation chamber and the baffle.

4. The liquid reservoir according to claim 3, wherein the length of the exhaust pipe extending into the gas-liquid separation chamber is less than the length of the air intake pipe extending into the gas-liquid separation chamber.

5. A refrigerator, comprising:

an evaporator; and the liquid reservoir according to claim 1, connected to an evaporating pipe of the evaporator.

6. The refrigerator according to claim 5, further comprising:

a refrigerator body, provided with a bottom liner at a bottom of the refrigerator, the bottom liner defining a cooling chamber and a storage space, and the cooling chamber being arranged below the storage space; wherein the evaporator is entirely in a flat cuboid shape and is arranged at a front part of the cooling chamber; and the liquid reservoir is arranged behind the evaporator.

7. The refrigerator according to claim 6, wherein the liquid reservoir is arranged obliquely and upwards from the end with the air intake pipe.

8. The refrigerator according to claim 6, wherein the evaporator is a finned evaporator, comprising:

a group of fins, arranged in parallel along the front-and-back direction of the refrigerator body;

an evaporating pipe, penetrating through the fins; and support end plates, arranged on both sides of the fins, wherein an outlet of the evaporating pipe is arranged behind the support end plate on one side, and extends to the liquid reservoir in an arc shape.

9. The refrigerator according to claim 8, wherein the evaporator is obliquely arranged along the depth direction of the refrigerator relative to the horizontal direction, the oblique direction of the evaporator is upward from front to back of the refrigerator, and the refrigerator further comprises:

an air duct cover plate, arranged in the front of a back wall of the bottom liner, and defining an air supply duct with the back wall of the bottom liner, the air duct cover plate being provided with at least one air supply outlet, and the air supply outlet being used for connecting the air supply duct and the storage space; and a centrifugal fan, obliquely arranged on a back side of the evaporator entirely, and used for causing formation of a refrigerating airflow from air in front of the cooling chamber discharged to the air supply duct through the evaporator, the centrifugal fan inclining upward from front to back of the refrigerator, the distances from the center of an air inlet of the centrifugal fan to side plates on both sides of the bottom liner being different, and the distance from the center of the air inlet to a side wall of the bottom liner close to the outlet of the evaporating pipe being greater than the distance to a side wall of the bottom liner away from the outlet of the evaporating pipe.

* * * * *